US006557609B1

(12) United States Patent
Fini et al.

(10) Patent No.: US 6,557,609 B1
(45) Date of Patent: May 6, 2003

(54) APPARATUS FOR CUTTING AND APPLYING A TEARING STRIP TO A PACKAGING FILM

(75) Inventors: Fabio Fini, Pieve di Cento (IT); Giorgio Tassi, Bologna (IT)

(73) Assignee: BFB S.p.A., Bentivoglio (IT)

( * ) Notice: Subject to any disclaimer, the term of this patent is extended or adjusted under 35 U.S.C. 154(b) by 0 days.

(21) Appl. No.: 09/600,263

(22) PCT Filed: Feb. 3, 1999

(86) PCT No.: PCT/EP99/00703

§ 371 (c)(1),
(2), (4) Date: Jul. 13, 2000

(87) PCT Pub. No.: WO99/42370

PCT Pub. Date: Aug. 26, 1999

(30) Foreign Application Priority Data

Feb. 18, 1998 (IT) ..... BO98A0090

(51) Int. Cl.[7] ..... B32B 31/10; B65D 3/26

(52) U.S. Cl. ..... 156/530; 156/552; 156/580; 493/212; 53/412

(58) Field of Search ..... 156/510, 511, 156/530, 543, 580, 261, 353, 361, 552; 229/87.05; 493/212, 930; 53/412

(56) References Cited

U.S. PATENT DOCUMENTS 4,147,583 A * 4/1979 Deutschlander ..... 156/510
4,188,257 A * 2/1980 Kirkpatrick ..... 156/504
4,328,067 A 5/1982 Cesano ..... 156/511
4,462,523 A * 7/1984 Kerr ..... 198/810.02
4,617,683 A * 10/1986 Christoff ..... 383/35
4,709,130 A * 11/1987 Lodetti et al. ..... 140/139
5,119,927 A * 6/1992 Bruggemann ..... 198/846
5,614,267 A * 3/1997 Howlett ..... 198/847

* cited by examiner

*Primary Examiner*—Richard Crispino
*Assistant Examiner*—Cheryl N. Hawkins
(74) *Attorney, Agent, or Firm*—Larson & Taylor PLC

(57) ABSTRACT

At least one transverse blade (19) is mounted on one end of the body of the pressing device (12) which cyclically acts on the packaging film (1) so as to fix it to an underlying tearing strip (7) which is directed towards the film with an adhesive surface and is supported by a conveyor belt (3), said blade (19) cutting and dividing up to the required dimension the said tearing strip from the continuous tape from which the strip itself is obtained, while the said belt acts as a cutter counter-piece. Auxiliary blades (21, 121) are also mounted laterally and parallel on one end of the body of the pressing device, said blades (21, 121), during the active working phase of the said pressing device, interfering with the edge of the packaging film in order to form, on the latter, incisions located on the sides of the front gripping end of the tearing strip, in order to facilitate tearing of the packaging when the said strip (7) is operated.

13 Claims, 2 Drawing Sheets

APPARATUS FOR CUTTING AND APPLYING A TEARING STRIP TO A PACKAGING FILM

The invention relates to cellophaning machines intended to wrap in packaging film pre-packaged products provided with a transverse strip for tearing open the said packaging when the packaged product is used. In particular the invention relates to those machines in which the tearing strip is adhesive and is fed transversely with respect to the direction of feeding of the packaging film.

In this technical sector, the state of the art is at present represented by the solution shown schematically and in perspective in FIG. 1 of the accompanying drawings, where 1 indicates the packaging film which is unwound from a reel (not shown) and which is usually made to advance with an intermittent movement by suitable means in the direction indicated by the arrow 2. A belt-type conveyor 3 is arranged transversely underneath the film, said conveyor being usually formed by a toothed belt which is driven on toothed horizontal-axis pulleys 103 and which has an upper section located parallel to and at an appropriate distance from the film 1 and, by suitable means acting on one of the pulleys 103, is made to advance with an intermittent movement in the direction, for example, of the arrow 4. The upper section of the belt 3 slides sealingly on a straight and fixed manifold 6 which is connected at 106 to a suction source such that, via through-holes 5 of the belt, the upper section of the belt itself is constantly sucked and is able to retain and convey the tearing strip 7 which has an adhesive upper side and is unwound from a reel, not shown, and which, by means of jockey rollers, also not shown, and motor-driven drawing rollers 8 and transmission rollers 9 is fed with the correct orientation and at the correct speed on the said belt 3. Usually, the linear feeding speed of the belt 3 is suitably greater than the peripheral speed of the drawing rollers 8 so that the strip 7 is extended longitudinally on the said conveyor belt. A small wedge 10 is provided on the side of the film 1 and at an appropriate distance from the latter, on the upper section of the conveyor belt 3, substantially in contact therewith, which wedge is fixed to the base of the machine and is directed with its thickest part towards the film 1 and onto which the strip 7 rises and then descends, and a cutter 11 rotating on a horizontal axis 111 is also provided, said cutter interfering in synchronism with the top part of the wedge 10 in order to cut transversely the section of strip 7 to be positioned underneath the film 1, by an amount which is proportional to the width of the said film. Once cutting has been performed, when the cut strip section 7 has been correctly positioned underneath the film 1, the conveyor belt 3 stops and a pressing device 12 which is made of resiliently yielding material and is spring-loaded intervenes, said pressing device pushing the film 1 against the belt 3 so as to attach the tearing strip 7 to the said film, following which the pressing device is raised and the film 1 with the tearing strip is inserted into the packaging machine and the cycle described is repeated.

The front end of the tearing strip which, after the action of the cutter 11, is arranged on the top of the inclined surface 10, is not subject to the action of the suction holes 5 and is difficult to control and often follows the said rotating cutter 11, with all the drawbacks which are imaginable.

The invention intends to overcome these and other problems of the known art, with the following proposed solution. The cutting means 11–111 are eliminated and suitable cutting means are associated with the body of the pressing device 12, while the conveyor belt 3 is used also to perform the function of a cutter counter-piece.

Further characteristic features of the invention and the advantages arising therefrom will emerge more clearly from the following description of a preferred embodiment thereof, illustrated purely by way of a non-limiting example in the figures of the attached sheets of drawings, in which.

Figure 2:
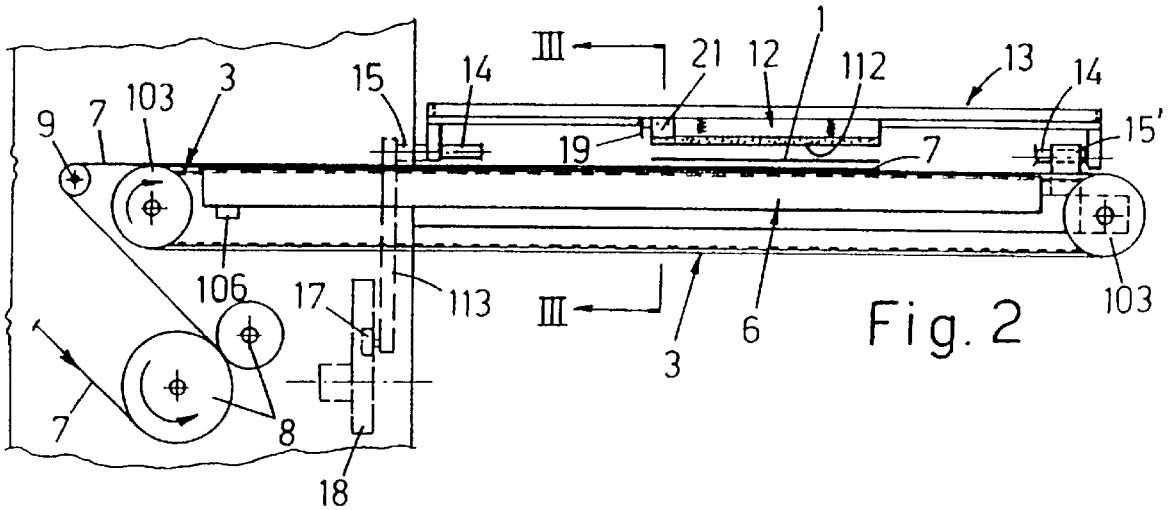
FIG. 2 is an elevation view from the front part of the apparatus in question.
Figure 3:
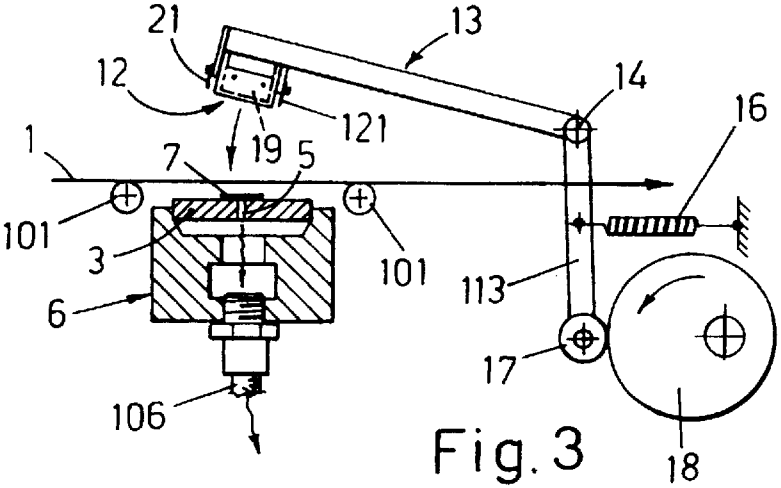
FIG. 3 shows the apparatus sectioned transversely along the line III—III of FIG. 2.

In FIGS. 2 and 3, the spring-loaded pressing device 12 is for example mounted on a structure 13 which oscillates on a pivoting shaft 14 parallel to the said pressing device and in turn rotatably supported by supports 15–15' which are integral with the base of the machine, the said oscillating structure being provided with a lever arm 113 which, by means of a resilient means 16, is kept in engagement via its end roller 17 with a cam 18 which is connected to the means which transmit the movement to the rollers 8 and to the driving pulley 103 of the belt 3. It is understood that other means may be used for alternate operation of the pressing device 12. Depending on the width of the film 1 fed to the packaging machine, the dimensions of the pressing device 12 will vary.

Figure 1:
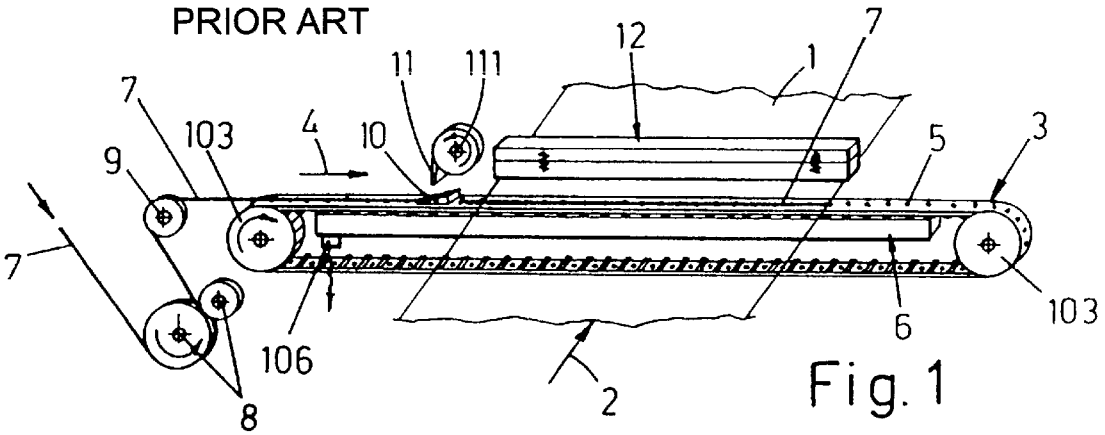
FIG. 1 is a diagrammatic perspective view illustrating the prior art, as above discussed.
Figure 5:
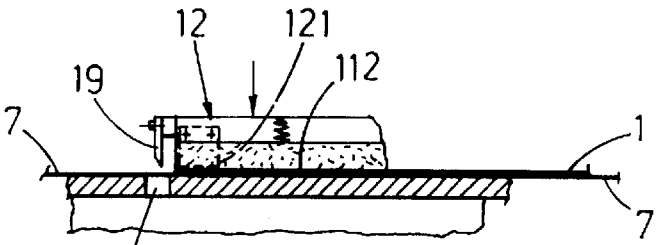

As mentioned in the introduction of the present description, the apparatus in question does not make use of the rotating cutter 11 and the fixed cutter counter-piece 10, as shown in FIG. 1. The end of the pressing device 12 which is located on the side where the strip 7 enters, is provided, integrally fixed to the body of the said pressing device or to the support structure 13, with a cutting means 19 formed for example by a small blade which is oriented for example transversely or with an appropriate inclination relative to the longitudinal axis of the pressing device and which has its cutting profile directed downwards and substantially touches the ideal plane on which the active front edge 112 of the pressing device lies or which is slightly raised from this ideal plane, as can be seen in detail in FIG. 5. The cutting edge of the blade 19 may be continuous, straight or saw-toothed.

Figure 6:
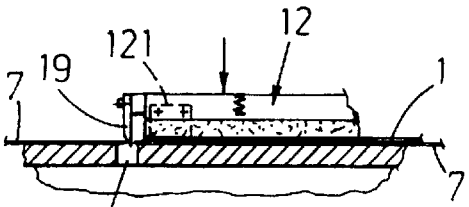
FIGS. 5 and 6 show details of the apparatus sectioned along the line V—V of FIG. 4 and during successive steps of the working cycle.

Once the correct section 7 of tearing strip has been positioned underneath the film 1, as in the known art, the belt 3 conveying the strip 7 stops and the pressing device 12 is quickly lowered so as to push the film underneath its own drive means 101 and cause it to adhere to the said strip 7. As shown in the sequence according to FIGS. 5 and 6, the assembly consisting of the film 1 and the strip 7, which is retained upstream by the conveying rollers 8 now at a standstill, is first firmly gripped on the conveyor belt 3 by the active part 112 of the pressing device 12 and the section thereof thus clamped together, following resilient deformation of the said pressing device by means of compression, is acted on by the blade 19 which touches and transversely cuts the strip 7 retained by the belt 3 which in this case also performs the function of a cutter counter-piece. Good results have been achieved with the use of a belt 3 made with elastomeric wear-resistant mixtures. Excellent results have also been achieved with the use of a belt 3 provided with transverse recesses 20 which are positioned cyclically opposite the blade 19 and into which the said blade 19 is inserted (FIG. 6) and thus protected from any contact with the belt, so as to ensure a long working life of the parts 3 and 19.

According to an alternative solution to that proposed, transverse recesses 20 are for example provided on the belt 3 and engaged by an insert of material which is suitable for co-operation with the blade 19 and if necessary may be replaceable.

Also in the apparatus according to the invention, the belt 3 travels at a linear speed which is suitably higher than the peripheral speed of the drawing rollers 8, so as to keep the strip 7 properly extended in the longitudinal direction, and means are provided to ensure that the travel of the said belt 3 stops when a recess 20 is aligned with the cutting blade 19. When there is a variation in the width of the film 1 and the consequent length of the strip section 7 to be positioned underneath the said film, means are provided so as to perform adjustment of the synchronism of the belt 3 with the pressing device 12, for example friction or engaging means which are located on the driving pulley 103 of the said belt and which allow this pulley to be rendered temporarily idle and perform manual feeding of the belt until one of its recesses 20 is aligned with a predefined reference point, for example with the cutting blade 19. If the means for conveying the tearing strip are operated by their own gearmotor connected via an electric shaft to the other parts of the apparatus and the packaging machine, it may be envisaged using a sensor, not shown, with a position which may be varied according to the width of the packaging film, so as to detect, directly or indirectly, the position of a recess 20 with respect to the cutting blade 19 or so as to perform cyclical stoppage of the said gearmotor.

Figure 4:
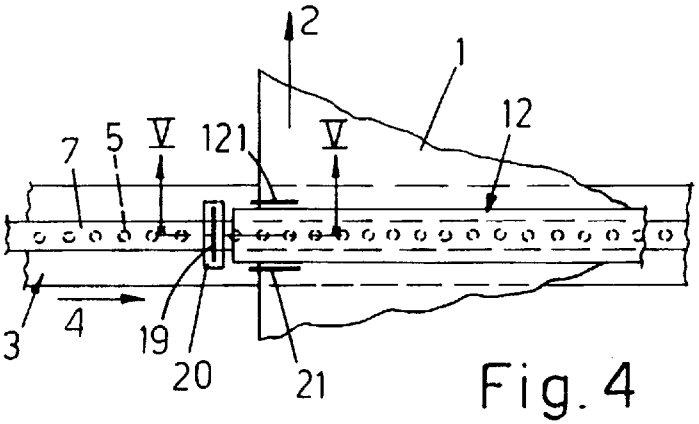
FIG. 4 shows a top plan view of the main part of the apparatus.

From FIGS. 2, 3 and 4, it can be seen that, in conjunction with the foregoing, it is preferably envisaged that one end of the body of the pressing device 12 is provided, for example in the region of the cutting blade 19 and laterally with respect to the pressing device itself, with auxiliary blades 21, 121 which are the same and parallel and have straight or saw-toothed cutting profile directed downwards and which, unlike the blade 19, are such that they do not substantially interfere with the belt 3, but interfere only with the film 1, so as to form, on the edge of the said film on which the gripping part of the tearing strip 7 is positioned, small cuts or incisions which are known and not shown and which subsequently facilitate tearing of the film itself when the said tearing strip is operated. If necessary, the conveyor belt 3 may be provided with small longitudinal and continuous grooves, not shown, into which the auxiliary blades 21, 121 may be partly inserted, as already mentioned in connection with the recesses 20 for the blade 19.

What is claimed is:

1. Apparatus for cutting a tearing strip section from a tearing strip supply and for attaching the tearing strip section to a packaging film for product packaging, comprising:

a straight belt conveyor having a belt with an upper section transversely, parallel, underneath and at a short distance with respect to a packaging film, which packaging film is fed forwards with an intermittent movement;

a synchrony means for moving said belt in synchronism with the intermittent movement of the packaging film;

at least one row of through-holes provided over an entire length of said belt; and a straight manifold upon which the upper section of the belt sealingly slides, said manifold being fixed and connected to a suction source such that said upper section of the belt is able to retain and convey a portion of a tearing strip supply which tearing strip portion has an adhesive side directed upwards;

cutting means which in synchronism with the synchrony means transversely cuts the tearing strip portion above the belt, so as to isolate from the said tearing strip portion a tearing strip section with a length adapted to a width of the packaging film located above;

a pressing device located above the packaging film which is parallel to the belt and which, upon stoppage of the belt by the synchrony means, is pushed by a pushing means against said belt so as to cause the packaging film to touch the adhesive side of the underlying tearing strip section and to become fixed thereto;

wherein said cutting means is mounted on one end of a body of the pressing device;

wherein said belt acts as an opposition element for said cutting means;

wherein the cutting means consists of a blade which is oriented with a cutting profile towards the belt conveying said tearing strip portion, and wherein said cutting profile is substantially at a same height and is slightly displaced with respect to a bottom and a working side of the pressing device so that the pressing device firstly grips on the belt an assembly consisting of the packaging film and the underlying tearing strip portion;

wherein the body of the pressing device is resiliently mounted relative to the working side of the pressing device to provide an overtravel for the body after the working side has engaged the belt; and further including drawing rollers which retain the tearing strip portion at a standstill when said pressing device is activated so that, only subsequently, following the overtravel of the resilient support body of the pressing device, is the blade able to touch and cut said tearing strip portion.

2. Apparatus according to claim 1, in which the blade intended to cut the tearing strip portion has a straight cutting profile.

3. Apparatus according to claim 1, in which the blade intended to cut the tearing strip portion has a saw-toothed profile.

4. Apparatus according to claim 1, in which a part of the belt intended to engage the tearing strip portion is formed at least partly of a wear-resistant elastomeric material.

5. Apparatus according to claim 1, in which the belt intended for conveying of the tearing strip portion is provided with equidistant recesses, and in which said synchrony means stops the belt with one said recess opposite the cutting blade and into which said blade penetrates such that the cutting profile of the cutting blade does not touch the belt.

6. Apparatus according to claim 1:

in which the belt intended for conveying of the tearing strip portion is provided with equidistant recesses;

in which said synchrony means stops the belt with one said recess opposite the cutting blade; and in which said recesses are each engaged by an insert which opposes the action of said blade.

7. Apparatus according to claim 1, further including, at one end of the body of the pressing device and laterally with respect thereto, parallel auxiliary blades which have a cutting profile directed downwards so as to form small cuts on an edge of the packaging film, laterally and in a region of a front end of the tearing strip section fixed onto said film, so as to facilitate tearing of said film at a time of use of said tearing strip section.

8. Apparatus according to claim 7, in which the auxiliary blades use as a cutter counter-piece the belt conveying the tearing strip portion, without however substantially touching the belt.

9. Apparatus according to claim 7, in which the auxiliary blades use as a cutter counter-piece the belt (3) conveying the tearing strip portion, which belt is provided with longitudinal recesses into which said auxiliary blades are able to penetrate partly.

10. Apparatus according to claim 1, wherein the cutting profile of the blade is oriented transversely to the belt.

11. Apparatus according to claim 1, wherein the cutting profile of the blade is oriented with an inclination relative to the belt.

12. Apparatus according to claim 4, in which the part of the belt intended to engage the tearing strip portion is wholly formed of the wear-resistant elastomeric material.

13. Apparatus according to claim 6, in which the inserts are renewable.

* * * * *